US009326575B2

(12) United States Patent
Moore

(10) Patent No.: US 9,326,575 B2
(45) Date of Patent: May 3, 2016

(54) MOBILE OFFICE

(71) Applicant: Jonie Thames Moore, Los Angeles, CA (US)

(72) Inventor: Jonie Thames Moore, Los Angeles, CA (US)

( * ) Notice: Subject to any disclaimer, the term of this patent is extended or adjusted under 35 U.S.C. 154(b) by 303 days.

(21) Appl. No.: 14/180,326

(22) Filed: Feb. 13, 2014

(65) Prior Publication Data

US 2014/0166414 A1 Jun. 19, 2014

Related U.S. Application Data

(63) Continuation-in-part of application No. 13/317,538, filed on Oct. 21, 2011, now abandoned.

(51) Int. Cl.

| | |
|---|---|
| ***A45C 5/14*** | (2006.01) |
| ***A45C 9/00*** | (2006.01) |
| ***A47B 3/10*** | (2006.01) |
| ***A45C 5/06*** | (2006.01) |
| *A47B 21/02* | (2006.01) |

(52) U.S. Cl.

CPC . *A45C 9/00* (2013.01); *A45C 5/065* (2013.01); *A45C 5/14* (2013.01); *A47B 3/10* (2013.01); *A45C 2009/002* (2013.01); *A47B 21/02* (2013.01)

(58) Field of Classification Search

CPC ..... A45C 9/00; A45C 5/065; A45C 5/14; A45C 2009/002; A47B 3/10; A47B 21/02

See application file for complete search history.

(56) References Cited

U.S. PATENT DOCUMENTS

| | | | | | |
|---|---|---|---|---|---|
| 811,475 | A * | 1/1906 | Bradley | A45C 9/00 | 190/8 |
| 2,264,744 | A * | 12/1941 | Dunnam | A01K 97/06 | 190/8 |
| 2,792,980 | A * | 5/1957 | Brown | A45F 3/04 | 224/235 |
| 5,630,537 | A * | 5/1997 | Sciacca | A01K 97/06 | 206/561 |
| 6,213,268 | B1 * | 4/2001 | Dancyger | A45C 13/02 | 150/113 |
| 6,435,390 | B1 * | 8/2002 | Abramowicz | A01K 97/06 | 224/629 |
| 6,454,064 | B1 * | 9/2002 | Cheng | A45C 9/00 | 190/11 |
| 6,749,273 | B1 * | 6/2004 | Peterson | A01K 97/06 | 190/110 |
| 7,278,644 | B2 * | 10/2007 | Villarreal | A47B 21/00 | 190/12 A |
| 7,416,066 | B2 * | 8/2008 | Chernoff | A45C 3/004 | 190/108 |
| D639,051 | S * | 6/2011 | Dare | D3/260 | |
| 8,567,577 | B2 * | 10/2013 | Jackson | A45B 23/00 | 190/109 |
| 2004/0026294 | A1 * | 2/2004 | Platte, III | A45C 13/02 | 206/575 |
| 2005/0098402 | A1 * | 5/2005 | Cohen | A45C 5/14 | 190/12 A |
| 2005/0121275 | A1 * | 6/2005 | Platte, III | A45C 5/14 | 190/103 |
| 2005/0145458 | A1 * | 7/2005 | Cohen | A45C 5/065 | 190/18 A |

* cited by examiner

*Primary Examiner* — Tri Mai

(74) *Attorney, Agent, or Firm* — Peter Gutenberg

(57) ABSTRACT

A mobile office comprising a wheeled luggage with telescoping handle; a top surface comprising an integrated seat; multiple internal and external storage compartments; a removable organizer drawer; and a removable table with extendable legs.

8 Claims, 8 Drawing Sheets

MOBILE OFFICE

CROSS-REFERENCE TO RELATED APPLICATION

This application is a continuation-in-part application of U.S. application Ser. No. 13/317,538, filed Oct. 21, 2011 which is incorporated herein by reference.

BACKGROUND OF THE INVENTION

In the modern professional world, more and more of the work which was traditionally done in a stationary office must be performed at off-site areas, i.e. "the field", where a traditional workspace, such as a desk and chair, may not be available. Therefore, there is a great need for a convenient, mobile office facility which will provide the user with that workspace, as well as contain ample storage space for office supplies, such as writing utensils, paper, files and tablet computers, etc. The present invention relates to the field of luggage, more specifically, luggage for use as a mobile office, with an integrated seat top, storage areas and a removable table with foldable and telescoping legs; which will allow a user to comfortably and efficiently operate in the field.

SUMMARY OF THE INVENTION

The present invention is directed to a luggage which serves as a mobile office; which satisfies the need for a portable work station.

Briefly, the invention is a mobile office which consists of a standard piece of wheeled luggage having an integrated seat top, which opens up to reveal a top storage area; a lower storage area containing a removable organizer drawer; side and rear storage compartments; and a table with telescoping legs and a cup holder, which is sized in order to fit inside the rear storage area, when the legs are folded upright from the stowed position and extended; numerous side pockets; and a telescoping handle.

These together with additional objects, features and advantages of the mobile office will be readily apparent to those of ordinary skill in the art upon reading the following detailed description of presently preferred, but nonetheless illustrative, embodiments of the mobile office when taken in conjunction with the accompanying drawings.

In this respect, before explaining the current embodiments of the mobile office in detail, it is to be understood that the luggage is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the mobile office.

It is therefore important that the claims be regarded as including such equivalent construction insofar as they do not depart from the spirit and scope of the mobile office. It is also to be understood that the phraseology 10 and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
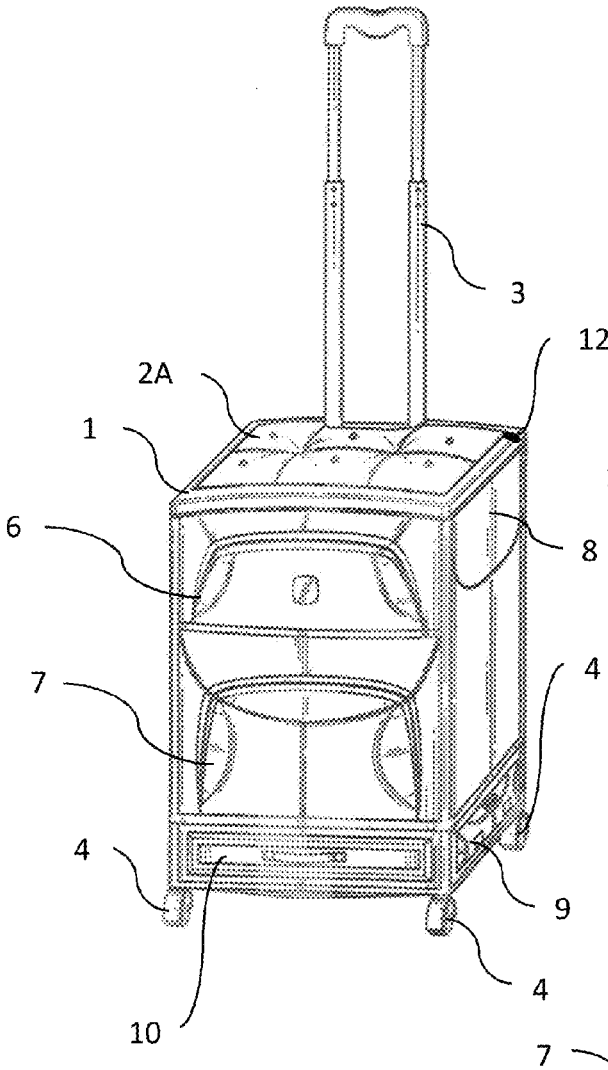
FIG. 1 illustrates a front, elevated, isometric view of the luggage with integrated seat folded flat upon the top surface and using a zipper as the fastening means.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-10.

Referring to FIGS. 1-4 and 6, a luggage 1 for use as a mobile office (hereinafter invention) includes a luggage 1 (hereinafter luggage) and a table. The luggage 1 is made of a material comprising a woven fabric, plastic, metal, wood, or carbon fiber composite. The luggage 1 contains a telescoping handle 7, one wheel at each corner 4 and an offset rear-center wheel 5, which serves to provide support and stability, while a person is seated on the atop the luggage 5. The luggage 1 may resemble a traditional suitcase or a more modern form of luggage that includes wheels and a handle 7. The exterior of the luggage 1 contains multiple exterior storage compartments 6, 7, 8, 9, 14; an upper storage compartment 6 and lower storage compartment 7 located on a front surface; an upper storage compartment 8 and lower storage 9 compartment located on a left and a right side surfaces; and a rear storage compartment 14.

Figure 3:
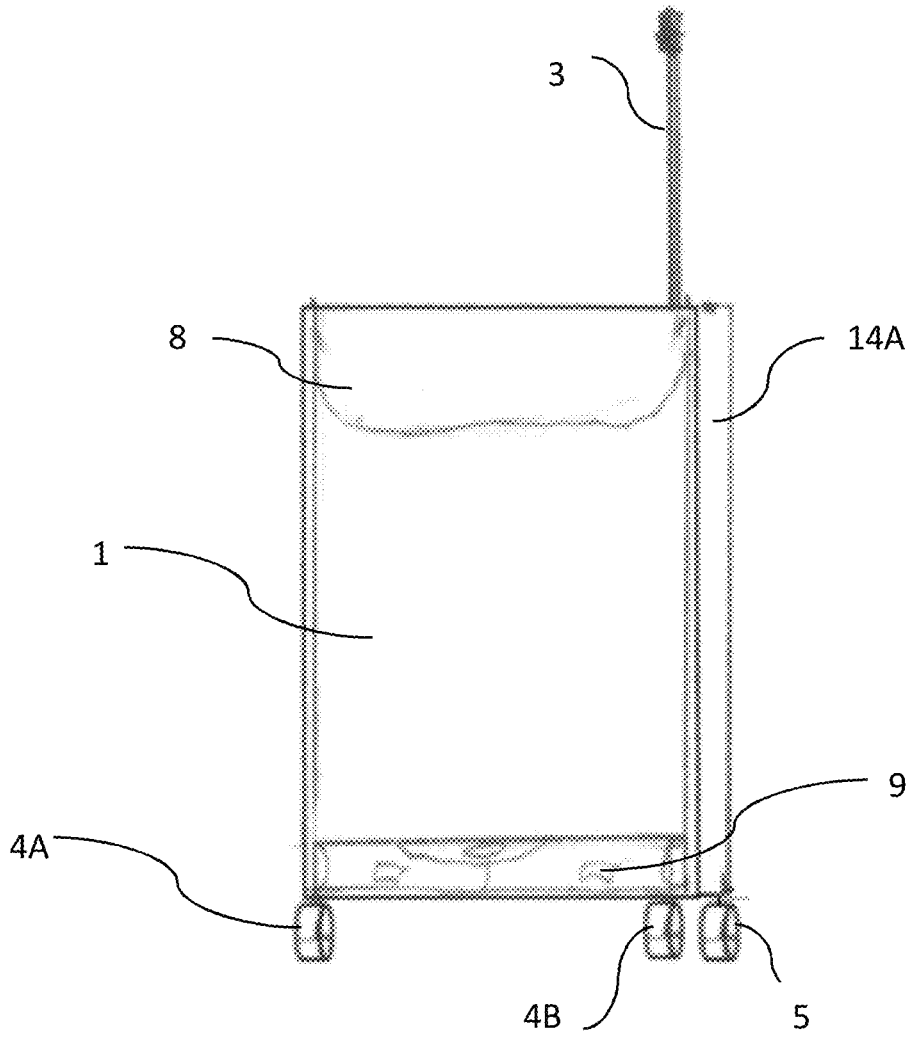
FIG. 3 illustrates a right side view of the luggage, with the rear compartment folded inward, in the closed position.
Figure 4:
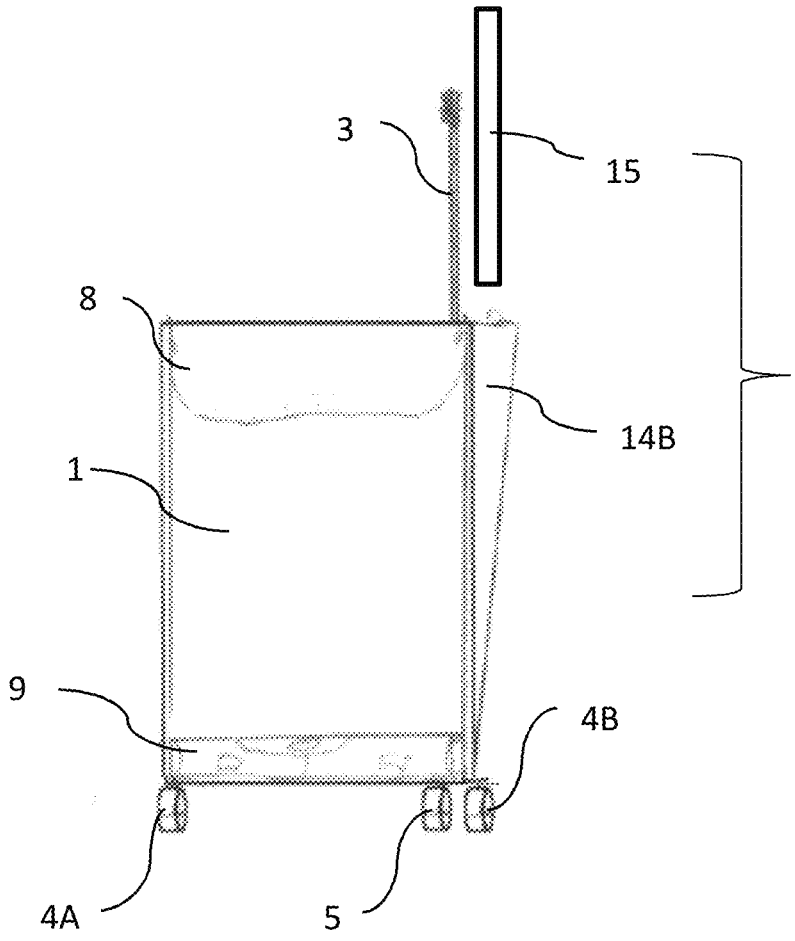
FIG. 4 illustrates an exploded, right side view of the luggage, with the rear compartment folded outward, in the in the open position, with a table being inserted into the rear compartment.

FIGS. 3 and 4 detail a side view of the luggage 1, with the rear, exterior storage compartment in the closed 14A and open position 14B, respectively. The rear, exterior storage compartment 14 is situated behind the telescoping handle 3 and folds outward from the top (FIG. 4) for accessibility, and provides storage space for a removable work table 15 (FIG. 4). The work table 15 is sized so that when the table legs are folded in, the work table 15 may be stowed in the rear storage compartment 14, so that the rear storage compartment 14 may be securely fastened closed 14B. The access points of the exterior compartments may be secured by various fastening means, such as zippers, plastic clasps, or snaps, etc.

Figure 2:
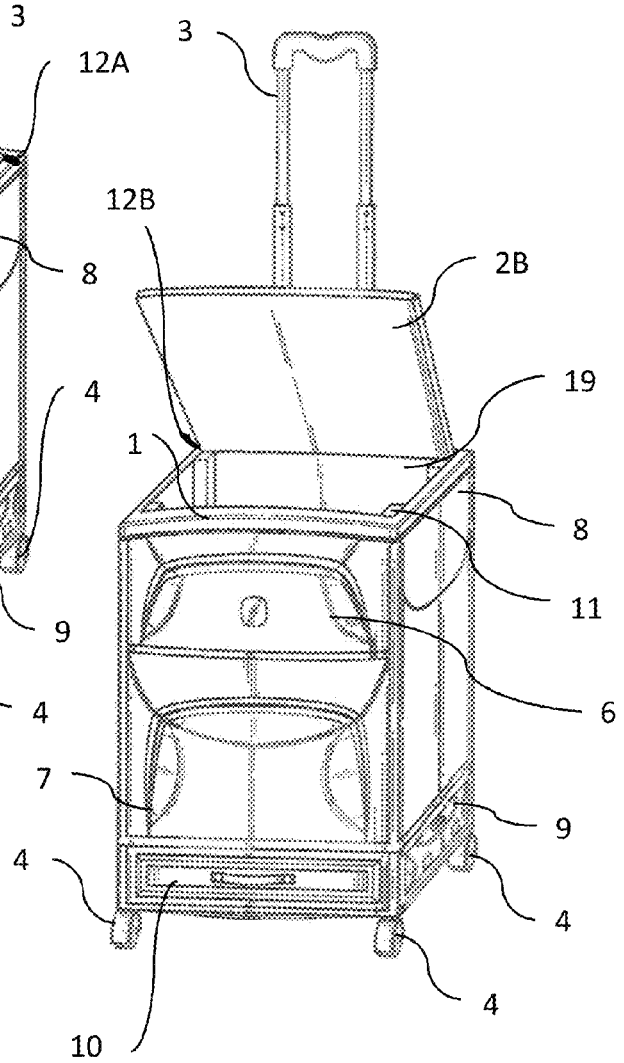
FIG. 2 illustrates a front, elevated, isometric view of the luggage with integrated seat in the opened position.

The top surface of the luggage forms an integrated seat 2. The integrated seat may be formed of a material comprising a soft material, such as foam or a woven fabric, plastic, metal, wood, or carbon fiber composite. The rear side of the integrated seat is attached directly to the luggage, a fastening means comprising a zipper 13 runs around a front side, left side, and/or right side which secures the front and sides of the integrated seat 2A to the luggage. An upper, interior storage compartment is accessible, when the zipper 13 is in the open position and the integrated seat is folded upwards 2B (FIG. 2)

Figure 6:
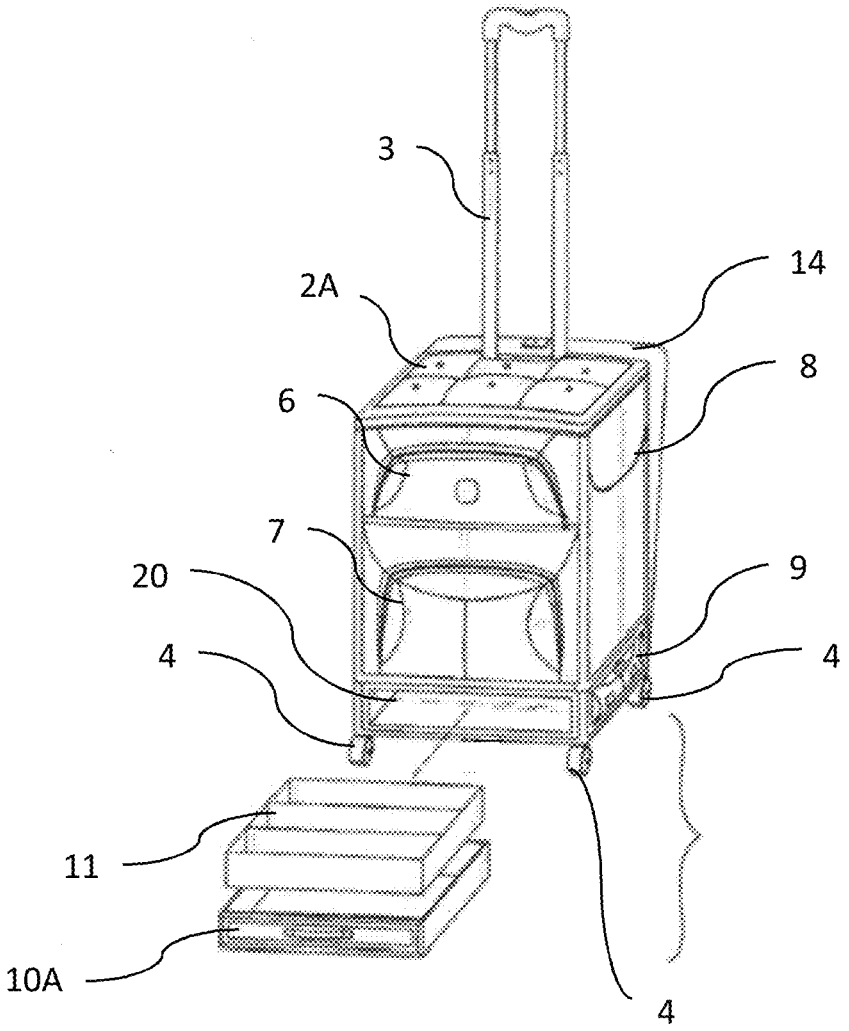
FIG. 6 illustrates an exploded, front, elevated, isometric view of the luggage with the drawer and organizer removed from the lower compartment, with said organizer removed from said drawer.

The interior of the luggage is comprised of an integrated support frame 12 and two separate compartments; an upper interior compartment 19 and a lower interior compartment 20 (see FIG. 6). The lower compartment 20 containing space for a removable drawer 10. The removable drawer 10, itself contains a removable organizer 11 (FIG. 6). The upper storage interior compartment 19 (see FIG. 2) provides a storage space for any other materials needed by the user in conduct of his or her business. The lower storage compartment contains a removable drawer 10 and 10A (see FIGS. 1 and 6).

Figure 5:
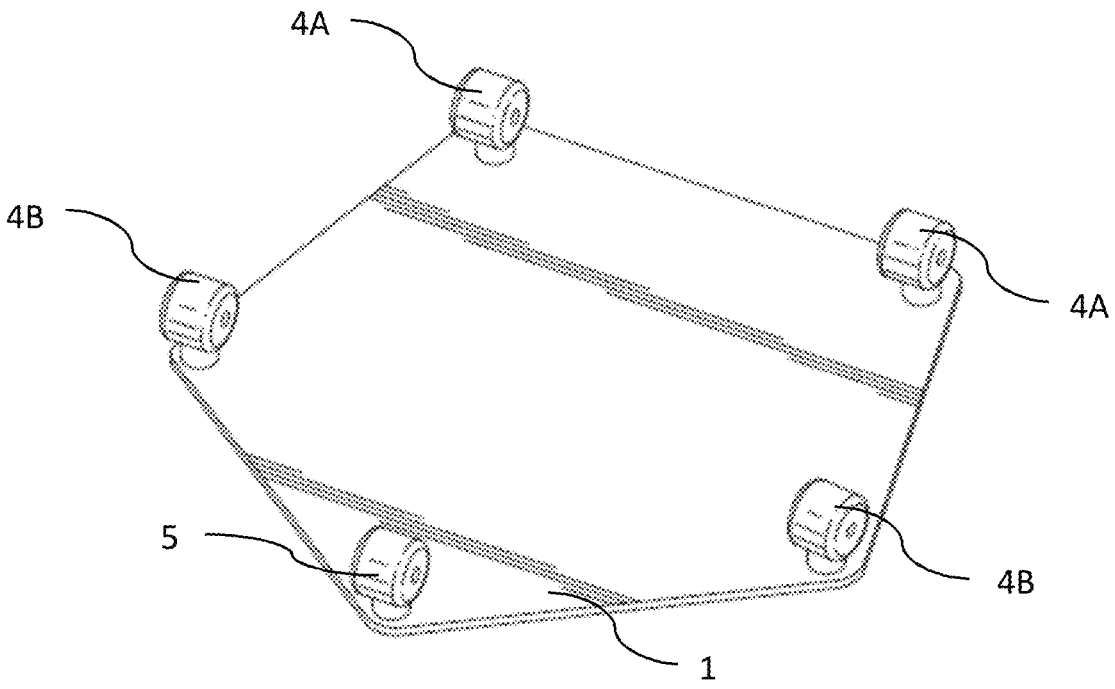
FIG. 5 illustrates a perspective view of the underside of the luggage.

Turning now to FIG. 5, which details a perspective view of the underside of the luggage. In the preferred embodiment, the luggage contains five wheels; one wheel is set at each front 4A and rear corner 4B of the luggage, with an offset rear-center wheel fifth wheel 5. The placement of the fifth wheel is to provide support and stability to a user seated atop the luggage. Alternative embodiments may utilize a three or four wheel configuration; or utilize support pegs, in lieu of the frontal wheels.

Turning now to FIG. 6, which details an exploded view of the luggage, with the removable drawer removed and a removable organizer tray, which fits in the removable drawer 8.

Figure 7:
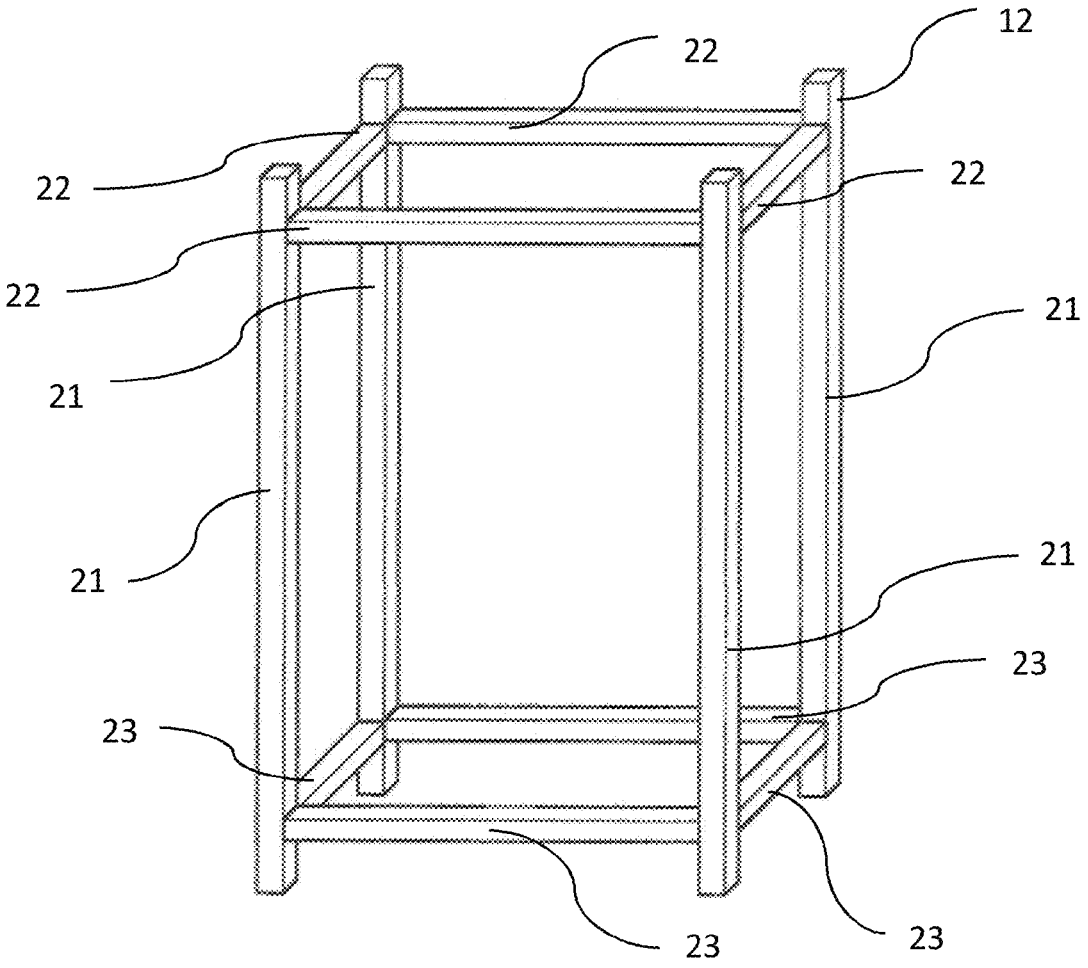
FIG. 7 illustrates an isometric view of the luggage frame.

Turning now to FIG. 7, which details the interior support frame 12. The interior support frame 12 is composed of four vertical members 21 and four upper horizontal members 22 and four lower horizontal members 23. The four vertical members 21 are substantially parallel to each other and substantially perpendicular to each horizontal member 22. One vertical member 21 is located at each corner of the luggage (see FIG. 2). Each horizontal member 22, 23 is planar and perpendicular to the horizontal member 22, 23 on its left and right side; and parallel to the horizontal member 22, 23, above or below it. The horizontal members 22,23 are arranged so that each horizontal member 22,23 will bridge two vertical members 21 to one another; with an upper horizontal member 22 bridging the upper ends of two vertical members and a lower horizontal member 23 bridging the lower ends of two vertical members 21.

Figure 8:
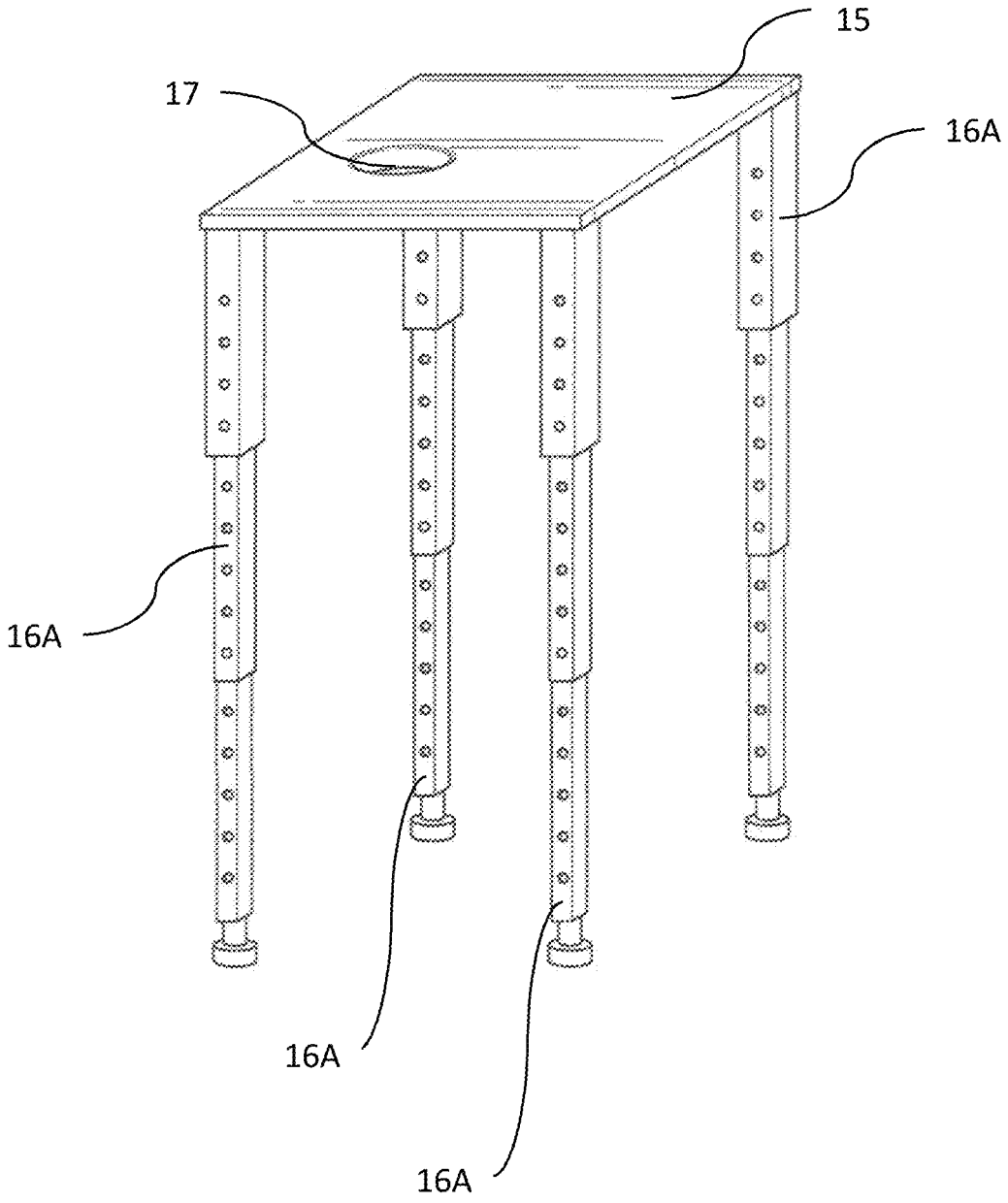
FIG. 8 illustrates an elevated isometric view of a table with a cup holder and folding legs; with said telescoping legs in an extended position.
Figure 9:
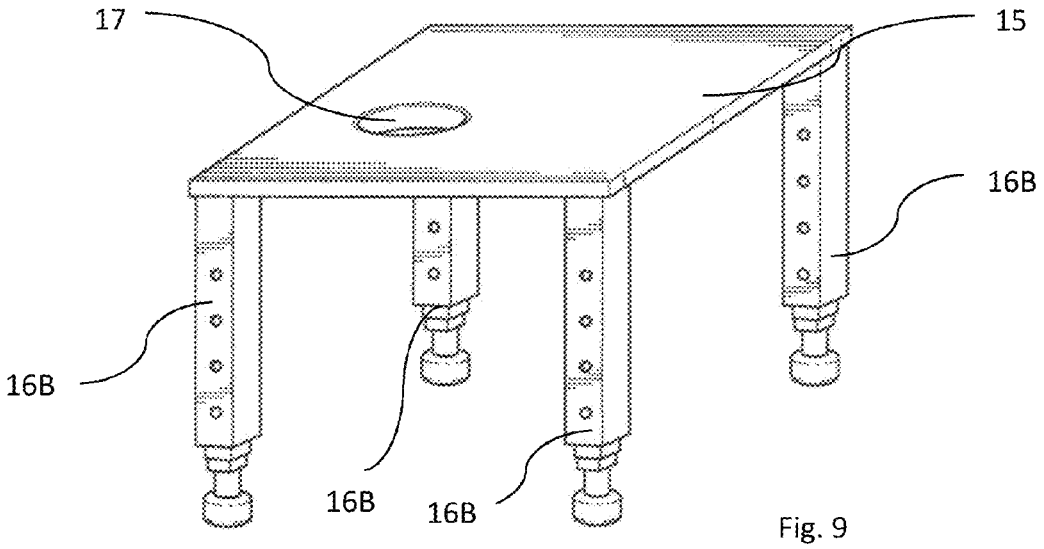
FIG. 9 illustrates an elevated, isometric view of a table with a cup holder and folding legs; with said telescoping legs in an contracted position.
Figure 10:
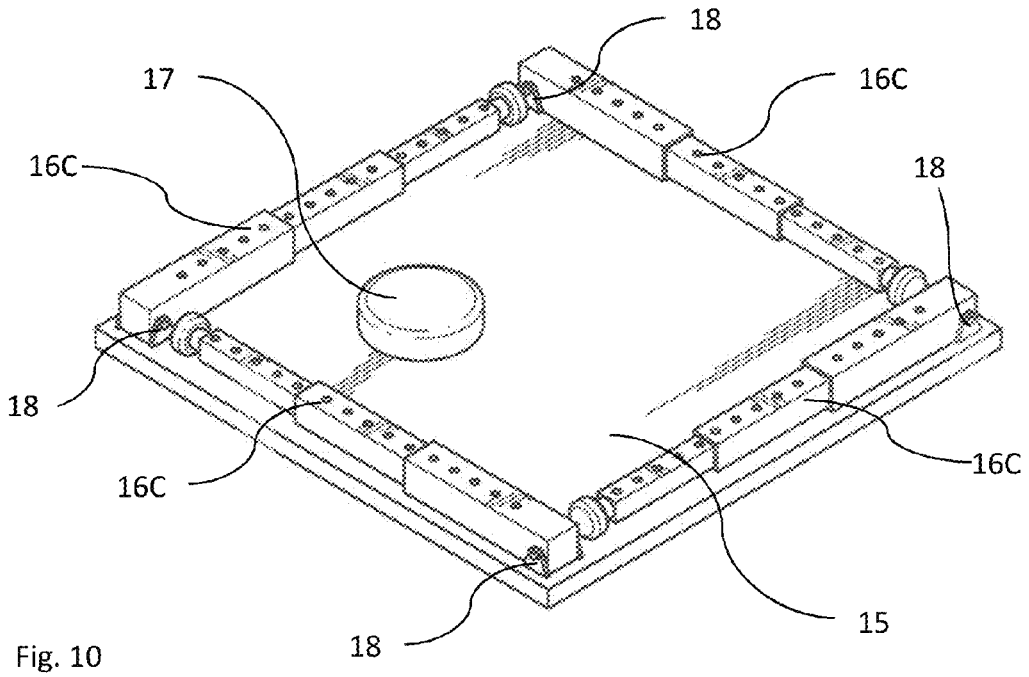
FIG. 10 illustrates an elevate, isometric view of the underside of a table with a cup holder and folding legs; with said folding legs contracted and folded inward.

Turning now to FIGS. 8-10, which detail a quadrangular, removable work table 15, with a cup holder 17 in one corner of a top surface and four, folding, telescoping legs 16 attached to the bottom surface, with one telescoping leg 16 located at each corner of said work table 15. The table 15 is made of a material comprising a plastic, metal, wood, or carbon fiber composite. Alternatively, the table surface could be in any number of shapes, including: circular, ovular, triangular, etc. . . . ; the table could also possess three or more legs.

The cup holder 17 consists of a pre-defined circular opening of a set diameter, which is located in one of the corners of the top surface of the work table 15. The cup holder 17 is capable of supporting in an upright position a cup or other liquid container, which may fit within the cup holder 17 (aluminum can, plastic bottle, etc.). A cup or plastic bottle or aluminum can may rest in the cup holder 17 provided the overall diameter of the cup et al. is less than or equal to the diameter of the cup holder 17.

FIG. 8 details the work table with the telescoping legs 16 in an extended and upright position 16A; when extended, the legs will allow for the placement of the table over the lap of an average size human, while the legs touching the ground.

FIG. 9 details the work table 15 with the telescoping legs 16 in a contracted position and upright position 16B.

FIG. 10 details the work table 15 with four telescoping legs in a contracted and closed position 16C. From the closed position 16C, the telescoping legs are substantially parallel to the surface of the work table 15. The telescoping legs are attached to the work table 15 by hinges 18 attached to the underside of the work table. The telescoping legs pivot on said hinges 18 to a substantially perpendicular and upright position by pivoting on said hinges 18.

Each table leg folds out on a hinge located at the connection point between the table top and the leg. Once in the extended position, the table legs telescope out so that they reach the floor when placed over the lap of a sitting person. FIG. 10 details the table 16 with each of its four legs 10 a in the stowed position. Each telescoping leg is designed to fold and fit securely against the underside of the table top, while remaining attached.

With respect to the above description, it is to be realized that the optimum dimensional relationship for the various components of the invention, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An apparatus comprising a luggage and removable work table: wherein the luggage comprises a top surface consisting of an integrated seat, a lower interior storage compartment, an upper interior storage compartment, a left side and a right side, both with upper and lower exterior storage compartments, a rear storage compartment on a rear side; wherein the integrated seat of the luggage folds upwards to access the upper storage compartment; wherein the means for fastening and securing the upper interior storage compartment of the luggage comprises a zipper that runs around a front side, left side, and/or right side of each compartment; wherein the rear exterior rear storage compartment of the luggage folds outward from the top surface; wherein, means to fasten and secure the exterior storage compartments comprise a zipper that runs around a front side, left side, and/or right side of said top surface, a button or a clasp; wherein, the lower front storage compartment of the luggage contains a removable drawer and drawer organizer; wherein the luggage comprises up to five wheels and includes an extendable, telescoping handle; wherein the table comprises a substantially planar surface, with a top surface and a bottom surface; wherein the top surface of said table includes a cup holder comprising a circular opening located at a corner; wherein, the table is supported by up to four folding and telescoping legs, attached to the bottom surface of the table.

2. The apparatus of claim 1, wherein the integrated seat of the top surface of the luggage is reinforced by front and rear frames located in the interior of the luggage, in a direction, perpendicular to the integrated seat and parallel to the front surface.

3. The apparatus of claim 1, wherein the luggage contains exactly four wheels.

4. The apparatus of claim 1, wherein the luggage contains exactly five wheels.

5. The apparatus of claim 1, wherein the work table further comprising a quadrangular planar surface and exactly four legs, with one end of each leg attached to the bottom surface of the table.

6. The apparatus of claim 1, wherein the work table further comprising a quadrangular planar surface and exactly three legs, with one end of each leg attached to the bottom surface of the table.

7. The apparatus of claim 1, wherein the length of each telescoping leg of said work table when folded out and in the extended position is approximately equal to the distance between an adult human abdomen and ground, when in the seated position.

8. The apparatus of claim 1, wherein the work table is stowed in the luggage by folding in the telescoping legs and placing the work table in the rear storage compartment of the luggage.

* * * * *